US006991119B2

(12) United States Patent
Puszkiewicz et al.

(10) Patent No.: US 6,991,119 B2
(45) Date of Patent: Jan. 31, 2006

(54) MEASUREMENT SYSTEM AND METHOD FOR ASSESSING LIFT VEHICLE STABILITY

(75) Inventors: Ignacy Puszkiewicz, Smithsburg, MD (US); Mohamed Yahiaoui, Hazard, KY (US); Louis A. Bafile, Mercersburg, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 26 days.

(21) Appl. No.: 10/098,629

(22) Filed: Mar. 18, 2002

(65) Prior Publication Data

US 2003/0173324 A1 Sep. 18, 2003

(51) Int. Cl.
*B66C 13/16* (2006.01)

(52) U.S. Cl. ..... 212/277; 73/767; 212/261; 212/270; 212/278

(58) Field of Classification Search ..... 212/277, 212/278, 270, 238, 261; 414/619; 73/767
See application file for complete search history.

(56) References Cited

U.S. PATENT DOCUMENTS

| | | | | |
|---|---|---|---|---|
| 3,638,211 A | | 1/1972 | Sanchez | |
| 3,641,551 A | | 2/1972 | Sterner et al. | |
| 3,695,096 A | | 10/1972 | Kutsay | |
| 3,713,129 A | | 1/1973 | Buchholz | |
| 3,740,534 A | | 6/1973 | Kezer et al. | |
| 3,871,528 A | | 3/1975 | Wilkinson | |
| 4,042,135 A | | 8/1977 | Pugh et al. | |
| 4,576,053 A | * | 3/1986 | Hatamura | 73/862.629 |
| 4,743,893 A | | 5/1988 | Gentile et al. | |
| 4,752,012 A | | 6/1988 | Juergens | |
| 4,815,614 A | | 3/1989 | Putkonen et al. | |
| 4,895,262 A | | 1/1990 | Maso | |
| 5,058,752 A | | 10/1991 | Wacht et al. | |
| 5,160,055 A | | 11/1992 | Gray | |
| 5,186,042 A | * | 2/1993 | Miyazaki | 73/118.1 |
| 5,224,815 A | * | 7/1993 | Abels et al. | 414/635 |
| 5,359,516 A | | 10/1994 | Anderson | |
| 6,050,770 A | | 4/2000 | Avitan | |
| 6,062,106 A | | 5/2000 | Jackson et al. | |
| 6,098,823 A | | 8/2000 | Yahiaoui | |

* cited by examiner

*Primary Examiner*—Thomas J. Brahan
(74) *Attorney, Agent, or Firm*—Nixon & Vanderhye P.C.

(57) ABSTRACT

A measurement system uses dual axis force sensor pins to effectively assess the tipping moment of a load-bearing vehicle and anticipate imminent tipping in any direction. The pins are installed in the pivot points of the boom of a lift vehicle and its main lift cylinder, substituting the standard structural pins presently used. For non-traditional boom support arrangements, one sensor pin for each moving part attachment to non-moving turntable is required. Each of the sensors provides the actual force components acting on the sensor in two perpendicular axes. The output signals are then utilized to assess vehicle stability and detect when the machine is approaching instability in order to warn the operator and/or restrict vehicle movements.

23 Claims, 4 Drawing Sheets

BOOM ANGLE EVALUATION

MEASUREMENT SYSTEM AND METHOD FOR ASSESSING LIFT VEHICLE STABILITY

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a measurement system that effectively assesses the tipping moment of a load-bearing vehicle and anticipates imminent tipping in any direction. The system will allow for increased working envelope of the vehicle while providing a means to detect situations of improper operation or misuse.

Improper operation or misuse could occur, for example, if an operator attempts to lift extra weight and exceeds the machine capacity. When overloaded, the result could be loss of machine stability that leads to the machine tipping over. Improper operation or misuse could also arise if an operator gets the machine stuck in the mud, sand, or snow and proceeds to push himself out by telescoping the boom and pushing into the ground. This also leads, in addition to possible structural damage and malfunctioning of the machine, to a tipping hazard. A final example of improper operation or misuse could occur if an operator lifts a part of the boom onto a beam or post and continues to try to lift. The result is similar to the overloading case.

The use of stability limiting and warning systems in load bearing vehicles has been practiced for several years. Most systems have been in the form of envelope control. For example, given the swing angle, boom angle, and boom length, a conservative envelope stability system could be developed for a telescopic boom lift or crane. In this method, however, the number of sensors necessary to achieve the stability measurement is high and contributes to poor reliability and increased cost, especially for machines with articulating booms. In addition, the load in the platform needs to be independently monitored.

Another practiced method is to measure boom angle and lift cylinder pressure. In theory, as the load increases, the pressure in the cylinder supporting the boom also increases. But in reality, it is more complicated. At high angles, for example, much of the load's force passes into the boom's mounting pins and will not result in an appropriate increase in cylinder pressure. Also, hysterisis errors are significant; the pressures substantially differ for the same boom angle depending on whether the boom angle was reached by raising or lowering the boom.

Several other similar methods can also be found on the market. However, just as the two systems described above, they use a large number of sensors and lack the ability to address backward stability situations. Indeed, in the context of boom lifts, in addition to forward stability one needs to also monitor backward stability, which occurs when a boom is fully elevated and the turntable swung in the direction where the turntable counterweight contributes to a destabilizing moment.

BRIEF SUMMARY OF THE INVENTION

In order to use the least number of sensors and capture a backward moment, dual axis force sensor pins are provided according to the present invention. One sensor pin for each moving part attachment to non-moving turntable is required. In general, pins are installed in the pivot points of the boom and its main lift cylinder, substituting the standard structural pins presently used. Each of the sensors provides the actual force components acting on the sensor in two perpendicular axes. The output signals are then utilized by an on-board control system to assess vehicle stability and detect when the machine is approaching instability in order to warn the operator and/or restrict vehicle movements.

In an exemplary embodiment of the invention, a system for assessing stability in a boom lift vehicle is provided, where the boom lift vehicle incorporates a boom, a boom pivot, a main lift cylinder coupled with the boom, a main lift cylinder pivot, and vehicle driving components. The system includes a first force sensor pin installed in the boom pivot, and a second force sensor pin installed in the main lift cylinder pivot. The first force sensor pin detecting force components acting thereon via the boom pivot along two perpendicular axes, and the second force sensor pin detecting force components acting thereon via the lift cylinder along two perpendicular axes. A control system communicating with the vehicle driving components and the first and second force sensor pins assesses boom lift vehicle stability based on the force components acting on the first and second force sensor pins and controls the vehicle driving components based on boom lift vehicle stability.

The boom lift vehicle may further include a boom rest and a load cell coupled with the boom rest, wherein the control system determines boom lift vehicle stability based on a destabilizing moment (M), according to pre-established formulas. If no load cell is used, the control system may additionally determine whether the boom rests on the boom rest.

The control system may effect a continuous rated capacity of the boom lift vehicle, monitor a load on the boom lift vehicle, and/or determine boom angle based on the force components acting on the first and second force sensor pins. Boom angle ($\theta$) may be determined according to a formula.

The control system further determines boom structural load conditions via the force components acting on the first and second force sensor pins, and controls operation of the driving components based on the structural load conditions.

Preferably, each of the first and second force sensor pins includes an internal housing containing associated electronics therein including a pin microprocessor, wherein the pin microprocessor is configured to effect filtering and amplification of the detected force components and to store calibration factors and pin identity information.

In another exemplary embodiment of the invention, a method for assessing stability in a boom lift vehicle includes the steps of (a) detecting force components acting on the boom pivot along two perpendicular axes; (b) detecting force components acting on the main lift cylinder pivot along two perpendicular axes; and (c) assessing boom lift vehicle stability based on the detected force components and controlling the vehicle driving components based on boom lift vehicle stability. Step (c) may be practiced by assessing both forward and backward stability of the boom lift vehicle based on the detected force components.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
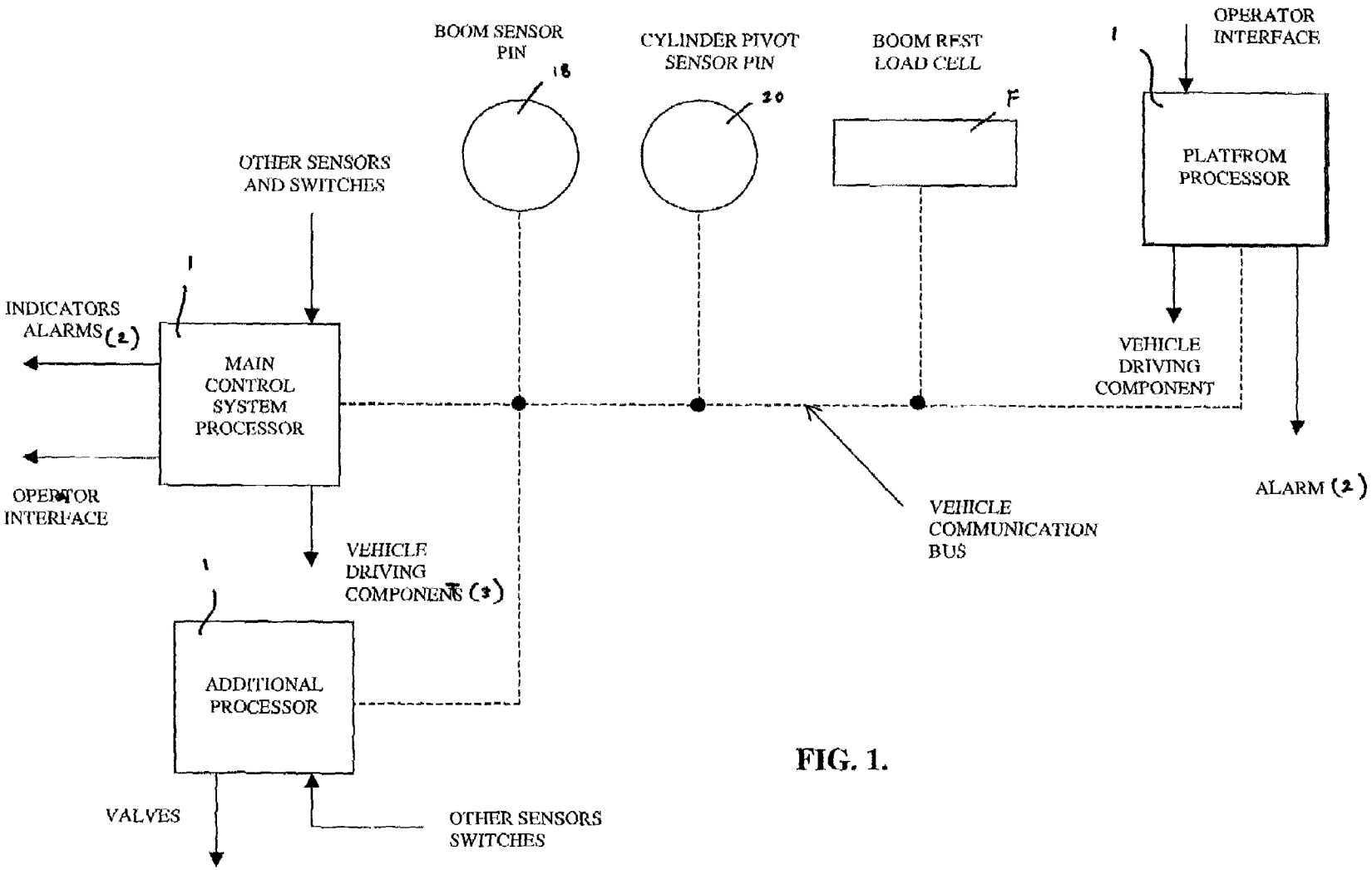
FIG. 1 is a block diagram of the system according to the present invention.

According to the present invention, dual axis force sensing pins are incorporated in booms and boom lift vehicles in place of standard pivot pins to enable a control system to assess vehicle stability. Generally, the dual axis force sensing pins are known. With reference to FIG. 1, these dual axis force sensing pins 18, 20 detect force components acting thereon along two perpendicular axes and communicate the detected force components to one or more communicating processors 1. The pins 18, 20 are preferably installed in the pivot points of the boom and its main lift cylinder, substituting the standard structural pins presently used. One sensor pin for each moving part attachment to non-moving turntable is required. Each of the sensors provides the actual force components acting on the sensor in two perpendicular axes. The output signals are then utilized by an on-board control system of the processors 1 to assess vehicle stability and detect when the machine is approaching instability in order to warn the operator via an alarm 2 or the like and/or restrict vehicle movement via communication with vehicle driving components 3.

Figure 2:
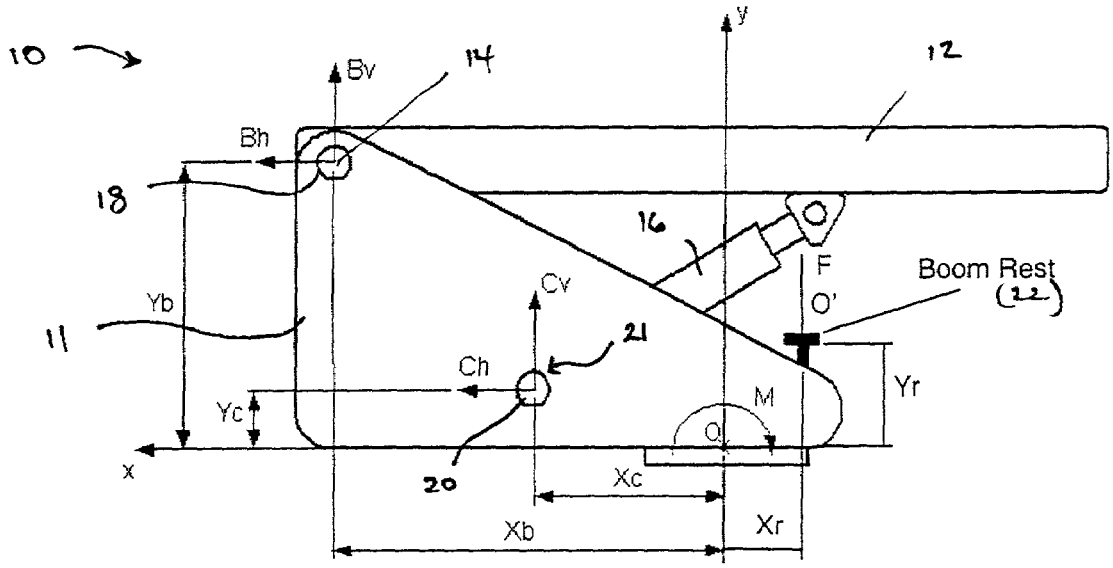
FIG. 2 is a schematic illustration of a boom lift vehicle showing the variables used for assessing vehicle stability.

FIG. 2 is a schematic illustration showing part of a boom lift vehicle 10 including a boom 12, a boom pivot 14 and a main lift cylinder 16. A first force sensor pin 18 is installed in the boom pivot 14, and a second force sensor pin 20 is installed in the main lift cylinder 16, at the pivot connection 21 of the lift cylinder to the vehicle turntable 11 as shown in FIG. 2. For alternative articulating booms that require a third pin or more, a force sensing pin should be installed at each boom moving part attachment to non-moving turntable. In FIG. 2, the first components for the first force sensor pin 18 are designated by Bv and Bh for vertical and horizontal force components, respectively. Similarly, the force components acting on the second force sensor pin 20 are designated Cv and Ch for the vertical and horizontal force components, respectively. Horizontal and vertical distances from the point around which the moment is determined are designated by Xb, Yb and Xc, Yc for the first and second force sensor pins 18, 20, respectively. Similar designations (Xr, Yr) are provided for the load cell F at a boom rest 22.

On the machines with a rotating turntable, if the boom rest 22 is monitored via load cell F, the moment is calculated around the center line of rotation point at the swing bearing. If the boom rest 22 is not monitored, then the same point of rotation is used when the boom 12 is not on the boom rest 22. Otherwise, when the boom 12 is on the boom rest 22, the point of contact of the boom 12 on the boom rest 22 is used as the point around which the moment is calculated. On the machines without a turntable (like traditional telescoping material handlers), any point can be selected for calculating the moment.

The moment (M) around point O is determined from the force components acting on the first and second force sensor pins. In this manner:

$$M=-Y_bB_h-Y_CC_h+X_bB_V+X_CC_V-X_rF$$

$$\begin{cases} -|M_{backward}| < M < +|M_{forward}|; & \therefore \text{safe operation} \\ M < -|M_{backward}| \text{ or } M > +|M_{forward}|; & \therefore \text{unsafe operation} \end{cases}$$

where:

$|M_{forward}|$ is maximum forward moment for stability, and $|M_{backward}|$ is maximum backward moment for stability.

A load (L) in the platform can be determined according to:

$$L=B_V+C_V+F-W,$$

where W is the constant and known weight of the upper structure (i.e., above turntable 11) including boom, platform and control box.

When the boom rest effect is not monitored, the moment (M) is determined according to:

$$M=M_O=-Y_bB_h-Y_CC_h+X_bB_V+X_CC_V$$

when the boom is not on the boom rest, and $$M=M_O=-(Y_b-Y_r)B_h-(Y_C-Y_r)C_h+(X_b+X_r)B_V+(X_C+X_r)C_V,$$

when the boom is on the boom rest.

In this context, if $$\arctan\left(\frac{C_V}{C_h}\right) \neq \alpha_r,$$

then boom is not on the boom rest, and:

$$\begin{cases} -|M_{backward\ o}| < M_o < +|M_{forward\ o}|; & \therefore \text{safe operation} \\ M_o < -|M_{backward\ o}| \text{ or } M_o > +|M_{forward\ o}|; & \therefore \text{unsafe operation} \end{cases}$$

where:

$|M_{forward\ o}|$ is maximum forward moment for stability around point O, and $|M_{backard\ o}|$ is maximum backward moment for stability around point O.

On the other hand, if $$\arctan\left(\frac{C_V}{C_h}\right) = \alpha_r,$$

then the boom is on the boom rest, and:

$$\begin{cases} -|M_{backward\ o'}| < M_{o'} < +|M_{forward\ o'}|; & \therefore \text{safe operation} \\ M_{o'} < -|M_{backward\ o'}| \text{ or } M_{o'} > +|M_{forward\ o'}|; & \therefore \text{unsafe operation} \end{cases}$$

where:

$|M_{forward\ o'}|$ is maximum forward moment for stability around point O', and $|M_{backward\ o'}|$ is maximum backward moment for stability around point O'.

If the boom is on the boom rest, the load in the platform cannot be predicted.

Figure 3:
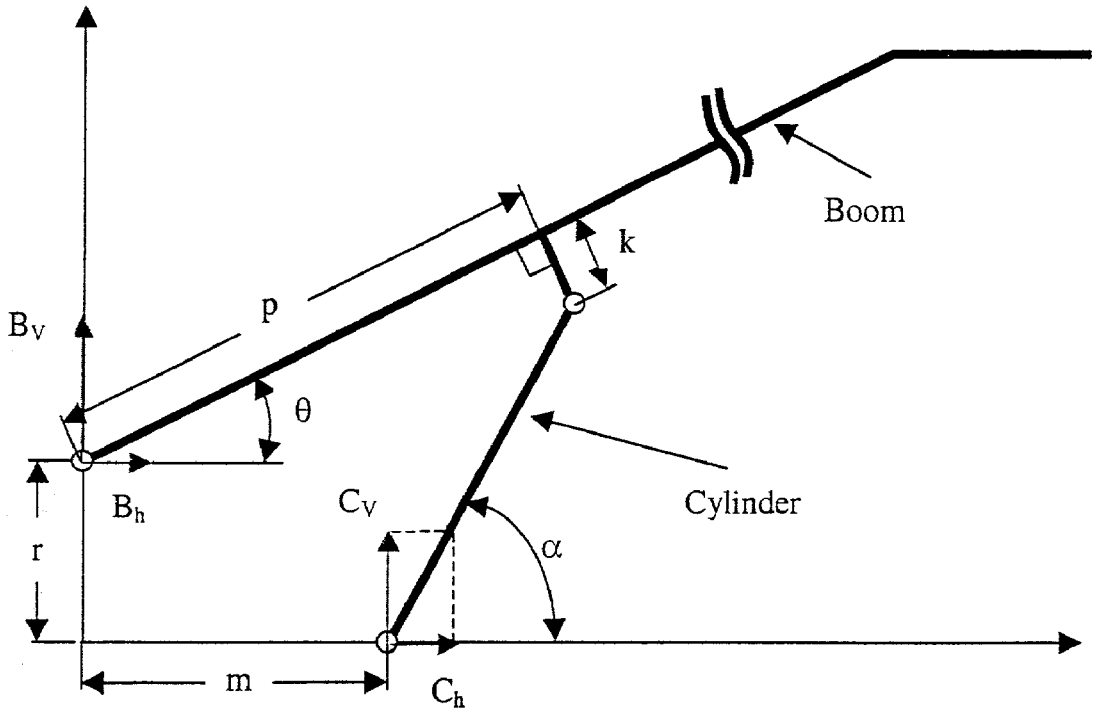
FIG. 3 is a schematic illustration of the boom lift vehicle showing variables for determining the cylinder angle and the boom angle.

With reference to FIG. 3, using the force component readings from the second force sensor pin 20, the cylinder angle ($\alpha$) and boom angle ($\theta$) can be determined. In this context:

1) Cylinder Angle $\alpha$:

$$\alpha = \arctan\left(\frac{C_V}{C_h}\right)$$

2) Boom Angle $\theta$:

From geometry $$\frac{C_V}{C_h} = \frac{r + p\sin\theta - k\cos\theta}{p\cos\theta + k\sin\theta - m}$$

solving this equation for $\theta$ leads to:

$$\theta = \arctan\left[\frac{kC_V - pC_h \pm \sqrt{(C_V^2 + C_h^2)(k^2 + p^2) + (mC_V + rC_h)^2}}{(m + p)C_V + (r + k)C_h}\right].$$

In some boom lift models, there is a need to have not only tipping protection but also structural overload protection in regions that are susceptible to structural damage before instability risks occur. In such cases:

$$\text{If } \theta = \arctan\left[\frac{kC_V - pC_h \pm \sqrt{(C_V^2 + C_h^2)(k^2 + p^2) + (mC_V + rC_h)^2}}{(m + p)C_V + (r + k)C_h}\right] < \theta_s,$$

then the boom is in a tipping dominant region, and previous discussion in predicting safe or unsafe operation applies.

$$\text{If } \theta = \arctan\left[\frac{kC_V - pC_h \pm \sqrt{(C_V^2 + C_h^2)(k^2 + p^2) + (mC_V + rC_h)^2}}{(m + p)C_V + (r + k)C_h}\right] > \theta_s,$$

then the boom is in a structural dominant region, and:

$$\begin{cases} -|M_{backward}^{structural}| < M < +|M_{forward}^{structural}|; & \therefore \text{safe operation} \\ M < -|M_{backward}^{structural}| \text{ or } M > +|M_{forward}^{structural}|; & \therefore \text{unsafe operation} \end{cases}$$

where:

$$|M_{forward}^{structural}|$$

is equivalent maximum forward moment for which boom is structurally safe, and $$|M_{backward}^{structural}|$$

is equivalent maximum backward moment for which boom is structurally safe.

As an alternative to the arctan calculations discussed above to determine whether the boom is on the boom rest, the system can sense such conditions by analyzing the sum of horizontal forces. Theoretically if $\Sigma F_X=0$, the boom is not on the boom rest, if $\Sigma F_X \neq 0$, the boom is on the boom rest or in contact with a free space obstacle.

Figure 4:
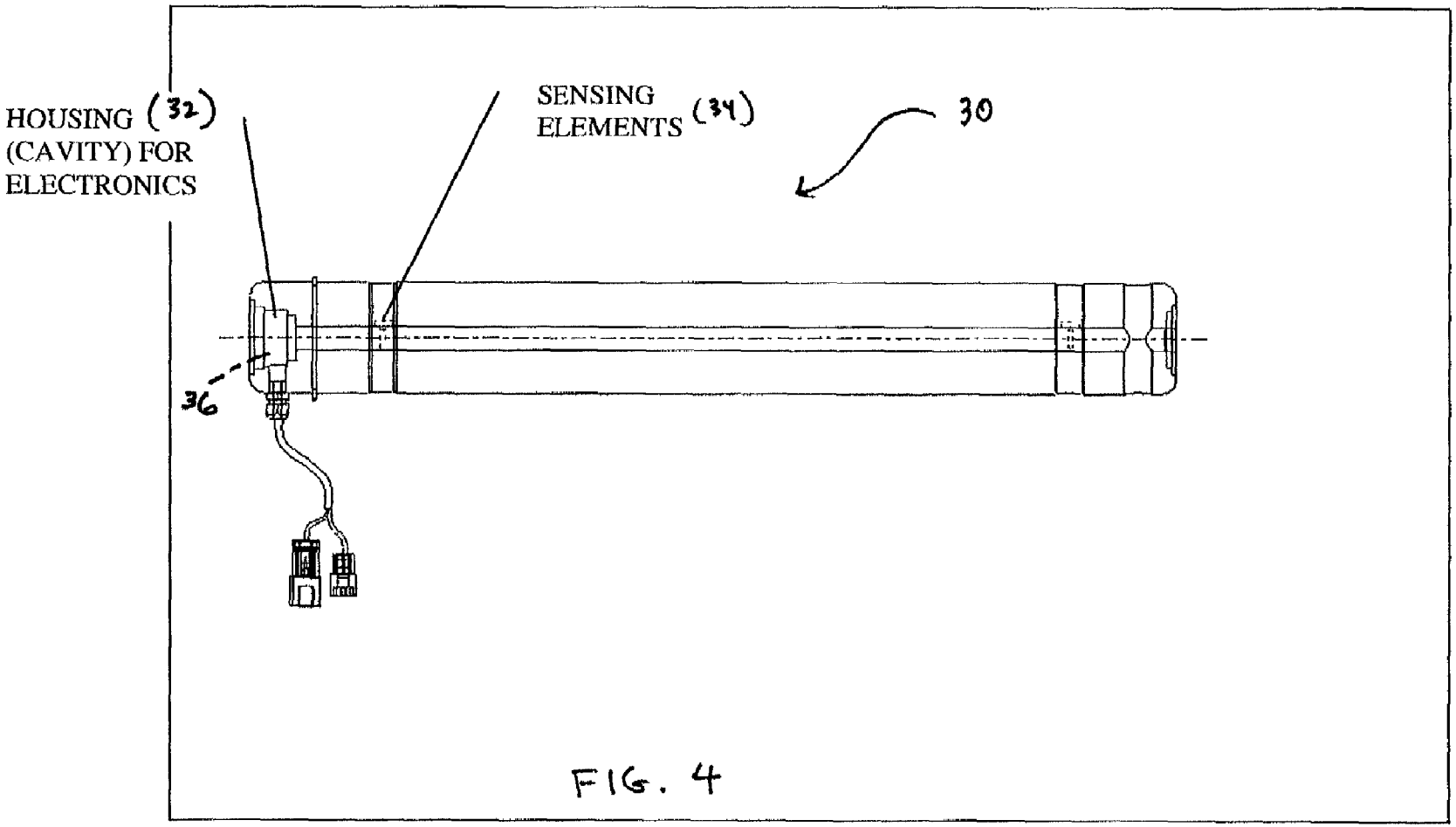
FIG. 4 illustrates an exemplary dual axis force sensing pin for use with the system according to the present invention.

As noted above, although generally conventional dual axis force sensing pins can be used according to the present invention, the invention more preferably incorporates a modified pin 30 as shown in FIG. 4. The modified pin includes, in addition to the sensing elements 34, a housing 32 therein to internally accommodate the device electronics. Additionally, a microprocessor 36 is embedded inside the pin for performing a number of operations within the pin itself. Operations performed include filtering, amplification, etc. The pin microprocessor 36 also stores the calibration factors and identity of pin information. In this manner, pin locations can be interchanged without any effect on either calibration factors or pin identity. Indeed, it is important to know where each pin is located for the exact computation of the moment from their force measurements. The pin according to the present invention permits it to broadcast its identity to the main processor where the moment computation is performed. The pin also broadcasts its calibration factors to the main processor.

This feature is particularly useful during assembly since there is no need to mark the pins for either the boom pivot or the main lift cylinder location. In a similar manner, there is no need to perform any additional system calibration above the factory individual pin calibration that is stored as stated within the pin.

By assessing stability using dual axis force sensing pins, the system of the invention can accurately and continuously assess true forward and backward tipping moments. As a result, the system can effect a continuous rated capacity as opposed to the current dual rating (such as fully extended, fully retracted). In addition, the upper and lower bounds can enable continuously more capacity with decreasing ground slope (using a chassis tilt monitor), and continuously more capacity from boom over the side to boom over front/back (conventionally, only rated for worse configuration—boom over the side). Design requirements can be relaxed, and machines can be pre-programmed for different reach and capacity. The system can derive/determine the load in the basket, thereby helping to prevent structural overload of basket attachments and the leveling system. By monitoring the load in the force sensor pins, the system can also detect imminent tipping due to external forces, other than the load in the platform. By monitoring moments and weight in the basket, the system can be used to store information about occurrence of excessive loads, and such information can be used when responding to warranty claims.

Additionally, for single rated boom lifts, the system according to the present invention prevents tipping regardless if overturning moment is due to overload or boom lifting into an obstacle, etc. Monitoring chassis tilt allows more capacity with decreasing ground slope up to structural limitations. Monitoring turntable position allows continuously more capacity from boom over the side to boom over the front/back up to structural limitations.

For dual rated boom lifts, the system provides a continuous capacity from highest rated load to lowest rated load. The conventional term "dual" in this context becomes obsolete since the boom becomes a multi-rated (continuous) boom lift. The highest rated capacity is dictated by structural limitations.

Finally, with respect to material handling equipment, the system according to the invention eliminates the need for a load chart. The system can also be configured to display (in a bar code type display or the like) available capacity. This advantage may be important for all telescopic material handlers (especially for machines with an aerial work platform attachment) where the platform capacity is not limited by structural limitations of the boom and platform leveling mechanism. Additionally, monitoring backward stability is currently not practiced in the industry, and as discussed above, backward stability is readily monitored with the system according to the present invention. Still further, the system could also be used to assess side tipping, which is an important issue in material handling equipment as such equipment usually do not include a swinging turntable.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A system for assessing stability in a boom lift vehicle including a boom, a boom pivot, a main lift cylinder coupled with the boom, a main lift cylinder pivot, and vehicle driving components, the system comprising:

a first force sensor pin installed in the boom pivot, the first force sensor pin detecting force components acting thereon via the boom pivot along two perpendicular axes;

a second force sensor pin installed in the main lift cylinder pivot, the second force sensor pin detecting force components acting thereon via the main lift cylinder along two perpendicular axes; and a control system communicating with the vehicle driving components and the first and second force sensor pins, the control system determining a destabilizing moment based on the force components acting on the first and second force sensor pins and based on horizontal and vertical distances from the first and second force sensor pins, respectively, to a point around which the moment is determined to thereby assess boom lift vehicle stability in at least forward and backward directions relative to a front and a rear of the boom lift vehicle, the control system controlling the vehicle driving components based on boom lift vehicle stability.

2. A system according to claim 1, wherein the control system effects a continuous rated capacity of the boom lift vehicle.

3. A system according to claim 1, wherein the control system monitors a load on the boom lift vehicle via the force components acting on the first and second force sensor pins.

4. A system according to claim 1, wherein the control system determines boom structural load conditions via the force components acting on the first and second force sensor pins, the control system controlling operation of the driving components based on the structural load conditions.

5. A system according to claim 1, wherein each of the first and second force sensor pins comprises an internal housing containing associated electronics therein including a pin microprocessor, the pin microprocessor being configured to effect filtering and amplification of the detected force components and to store calibration factors and pin identity information.

6. A system according to claim 1, further comprising an additional force sensor pin for each moving part attachment to non-moving turntable.

7. A system for assessing stability in a boom lift vehicle including a boom, a boom pivot, a main lift cylinder coupled with the boom, a main lift cylinder pivot, and vehicle driving components, the system comprising:

a first force sensor pin installed in the boom pivot, the first force sensor pin detecting force components acting thereon via the boom pivot along two perpendicular axes;

a second force sensor pin installed in the main lift cylinder pivot, the second force sensor pin detecting force components acting thereon via the main lift cylinder along two perpendicular axes; and a control system communicating with the vehicle driving components and the first and second force sensor pins, the control system assessing boom lift vehicle stability based on the force components acting on the first and second force sensor pins and controlling the vehicle driving components based on boom lift vehicle stability, wherein the boom lift vehicle further includes a boom rest and a load cell coupled with the boom rest, and wherein the control system determines boom lift vehicle stability based on a destabilizing moment (M), such that:

$$M=-Y_bB_h+Y_CC_h+X_bB_V+X_CC_V-X_rF,$$

where $X_b$, $Y_b$, $X_c$ and $Y_c$ are horizontal and vertical distances from the first and second force sensor pins, respectively, to a point around which the moment is determined, $X_r$ is a horizontal distance from the load cell to the point around which the moment is determined, $B_v$ and $B_h$ are vertical and horizontal force components for the first force sensor pin, respectively, $C_v$ and $C_h$ are vertical and horizontal force components for the second force sensor pin, respectively, and F is a force on the load cell.

8. A system according to claim 7, wherein the control system determines boom lift vehicle stability based on a destabilizing moment (M), such that:

$$M=M_O=-Y_bB_h-Y_CC_h+X_bB_V+X_CC_V,$$

when the boom is not on the boom rest, and $$M=M_O=-(Y_b-Y_r)B_h-(Y_C-Y_r)C_h+(X_b+X_r)B_V+(X_C+X_r)C_v,$$

when the boom is on the boom rest.

9. A system according to claim 8, wherein the control system determines whether the boom is on the boom rest such that if $$\arctan\left(\frac{C_V}{C_h}\right) \neq \alpha_r,$$

then the boom is not on the boom rest, where $\alpha_r$ is a reference angle of the main lift cylinder achieved when the boom is on the boom rest.

10. A system according to claim 8, wherein the control system determines whether the boom is on the boom rest such that if a vector sum of horizontal forces $B_h+C_h=0$ or less than a predetermined value, then the boom is not on the boom rest.

11. A system for assessing stability in a boom lift vehicle including a boom, a boom pivot, a main lift cylinder coupled with the boom, a main lift cylinder pivot, and vehicle driving components, the system comprising:

a first force sensor pin installed in the boom pivot, the first force sensor pin detecting force components acting thereon via the boom pivot along two perpendicular axes;

a second force sensor pin installed in the main lift cylinder pivot, the second force sensor pin detecting force components acting thereon via the main lift cylinder along two perpendicular axes; and a control system communicating with the vehicle driving components and the first and second force sensor pins, the control system assessing boom lift vehicle stability based on the force components acting on the first and second force sensor pins and controlling the vehicle driving components based on boom lift vehicle stability, wherein the control system determines boom angle based on the force components acting on the first and second force sensor pins.

12. A system according to claim 11, wherein the control system determines boom angle (θ) such that $$\theta = \arctan\left[\frac{kC_V - pC_h \pm \sqrt{(C_V^2 + C_h^2)(k^2 + p^2) + (mC_V + rC_h)^2}}{(m+p)C_V + (r+k)C_h}\right],$$

where k,m,p and r are geometrical design parameters, and $C_v$ and $C_h$ are vertical and horizontal force components for the second force sensor pin, respectively.

13. A system for assessing stability in a boom lift vehicle including a boom, a boom pivot, a main lift cylinder coupled with the boom, a main lift cylinder pivot, and vehicle driving components, the system comprising:

first detecting means for detecting force components acting on the boom pivot along two perpendicular axes;

second detecting means for detecting force components acting on the main lift cylinder pivot along two perpendicular axes;

means for determining a destabilizing moment based on the force components and based on horizontal and vertical distances from the first and second detecting means, respectively, to a point around which the moment is determined to thereby assess boom lift vehicle stability in at least forward and backward directions relative to a front and a rear of the boom lift vehicle; and means for controlling the vehicle driving components based on boom lift vehicle stability.

14. A method for assessing stability in a boom lift vehicle including a boom, a boom pivot, a main lift cylinder coupled with the boom, a main lift cylinder pivot, and vehicle driving components, the method comprising:

(a) detecting force components acting on the boom pivot along two perpendicular axes with a first force sensor pin;

(b) detecting force components acting on the main lift cylinder pivot along two perpendicular axes with a second force sensor pin;

(c) determining a destabilizing moment based on the detected force components and based on horizontal and vertical distances from the first and second force sensor pins, respectively, to a point around which the moment is determined to thereby assess boom lift vehicle stability; and controlling the vehicle driving components based on boom lift vehicle stability, wherein step (c) is practiced by assessing both forward and backward stability of the boom lift vehicle relative to a front and a rear of the boom lift vehicle based on the detected force components.

15. A method according to claim 14, wherein the boom lift vehicle further includes a boom rest and a load cell coupled with the boom rest, and wherein step (c) is practiced by determining boom lift vehicle stability based on a destabilizing moment (M), such that:

$$M=-Y_bB_h+Y_CC_h+X_bB_V+X_CC_V-X_rF,$$

where $X_b$, $Y_b$, $X_c$ and $Y_c$ are horizontal and vertical distances from the first and second force sensor pins, respectively, to a point around which the moment is determined, $X_r$ is a horizontal distance from the load cell to the point around which the moment is determined, $B_v$ and $B_h$ are vertical and horizontal force components for the first force sensor pin, respectively $C_v$ and $C_h$ are vertical and horizontal force components for the second force sensor pin, respectively, and F is a force on the load cell.

16. A method according to claim 15, wherein step (c) is practiced by determining boom lift vehicle stability based on a destabilizing moment (M), such that:

$$M=M_O=-Y_bB_h-Y_CC_h+X_bB_V+X_CC_V,$$

when the boom is not on the boom rest, and $$M=M_O=-(Y_b-Y_r)B_h-(Y_C-Y_r)C_h+(X_b+X_r)B_V+(X_C+X_r)C_v,$$

when the boom is on the boom rest.

17. A method according to claim 16, wherein step (c) further comprises determining whether the boom is on the boom rest such that if $$\arctan\left(\frac{C_V}{C_h}\right) \neq \alpha_r,$$

then the boom is not on the boom rest, where $\alpha_r$ is a reference angle of the main lift cylinder achieved when the boom is on the boom rest.

18. A method according to claim 16, wherein step (c) further comprises determining whether the boom is on the boom rest such that if a vector sum of horizontal forces $B_h+C_h=0$ or less than a predetermined value, then the boom is not on the boom rest.

19. A method according to claim 14, further comprising effecting a continuous rated capacity of the boom lift vehicle.

20. A method according to claim 14, further comprising monitoring a load on the boom lift vehicle via the detected force components.

21. A method according to claim 14, further comprising determining structural load conditions via the detected force components, and controlling operation of the driving components based on the structural load conditions.

22. A method for assessing stability in a boom lift vehicle including a boom, a boom pivot, a main lift cylinder coupled with the boom, a main lift cylinder pivot, and vehicle driving components, the method comprising:

(a) detecting force components acting on the boom pivot along two perpendicular axes;

(b) detecting force components acting on the main lift cylinder pivot along two perpendicular axes;

(c) assessing boom lift vehicle stability based on the detected force components and controlling the vehicle driving components based on boom lift vehicle stability; and (d) determining boom angle based on the detected force components.

23. A method according to claim 22, wherein the boom angle (θ) is determined such that $$\theta = \arctan\left[\frac{kC_V - pC_h \pm \sqrt{(C_V^2 + C_h^2)(k^2 + p^2) + (mC_V + rC_h)^2}}{(m + p)C_V + (r + k)C_h}\right],$$

where k, m, p, r are geometrical parameters, and $C_V$ and $C_h$ are vertical and horizontal force components for the second force sensor pin, respectively.

* * * * *